United States Patent [19]

Yanagisawa et al.

[11] Patent Number: 4,986,120

[45] Date of Patent: Jan. 22, 1991

[54] LOW-WATER-PRESSURE CONTROLLED HYDROLOGIC TEST METHOD

[75] Inventors: Koichi Yanagisawa, Toki; Yoichi Hirata, Tokyo, both of Japan

[73] Assignees: Doryokuro Kakunenryo Kaihatsu Jigyodan; Taisei Kiso Sekkei Co., Ltd., both of Tokyo, Japan

[21] Appl. No.: 361,883

[22] Filed: Jun. 6, 1989

[30] Foreign Application Priority Data

Jun. 9, 1988 [JP] Japan ..... 63-142399

[51] Int. Cl.[5] ..... E21B 47/06

[52] U.S. Cl. ..... 73/155; 166/250; 166/386

[58] Field of Search ..... 73/38, 151, 155; 166/66, 250, 113, 191, 385, 386, 387, 127

[56] References Cited

U.S. PATENT DOCUMENTS 4,790,378 12/1988 Montgomery et al. ..... 73/155

FOREIGN PATENT DOCUMENTS 49349 2/1939 France ..... 73/155

0232158 1/1986 German Democratic Rep. ... 73/155

2161943 1/1986 United Kingdom ..... 73/155

*Primary Examiner*—Hezron E. Williams

*Assistant Examiner*—Kevin D. O'Shea

*Attorney, Agent, or Firm*—Armstrong, Nikaido, Marmelstein, Kubovcik, & Murray

[57] ABSTRACT

A low-water-pressure-controlled hydrologic test using a measurement pipe containing an inner packer which is equipped with a water pressure gage at its tip is disclosed. Some water is poured into the measurement pipe in advance so as to diminish the pressure head difference between the in-pipe pressure and the pore water pressure of the rock concerned. The permeability coefficient is obtained by measuring changes in the recovered water level in terms of pressure changes. In the case of an aquiclude, the inner pressure is raised by expanding the inner packer, the permeability coefficient being obtained by detecting the changes in inner pressure. Thus, the method allows a permeability test to be conducted continuously at various depths. In addition, it helps to shorten the measurement time to a remarkable extent and enables the rock condition to be investigated without departing from the natural condition.

6 Claims, 7 Drawing Sheets

FIG. 4

| No. | Depth GL-M | Pore Water Pressure GL-M | Permeability Coefficient cm / sec | Test Method |
|---|---|---|---|---|
| 1 | 38.00 ~ 40.30 | 17.25 | $4.0 \times 10^{-4}$ | J |
| 2 | 44.65 ~ 46.95 | 20.48 | $7.7 \times 10^{-9}$ | P |
| 3 | 50.35 ~ 52.65 | 15.47 | $1.6 \times 10^{-7}$ | P |
| 4 | 52.35 ~ 54.65 | 16.72 | $5.3 \times 10^{-8}$ | P |
| 5 | 57.85 ~ 60.15 | 17.35 | $2.5 \times 10^{-5}$ | J |
| 6 | 60.50 ~ 62.80 | 17.20 | $3.9 \times 10^{-4}$ | J |
| 7 | 68.85 ~ 71.15 | 16.41 | $7.9 \times 10^{-8}$ | P |
| 8 | 77.70 ~ 80.00 | 17.29 | $3.9 \times 10^{-4}$ | J |
| 9 | 80.80 ~ 83.10 | 16.73 | $3.1 \times 10^{-4}$ | J |
| 10 | 101.45 ~ 103.75 | 17.10 | $3.3 \times 10^{-4}$ | J |
| 11 | 120.55 ~ 122.85 | 17.10 | $3.2 \times 10^{-4}$ | J |
| 12 | 159.25 ~ 161.55 | 17.24 | $1.3 \times 10^{-4}$ | J |
| 13 | 162.87 ~ 165.17 | 17.30 | $1.5 \times 10^{-4}$ | J |

LOW-WATER-PRESSURE CONTROLLED HYDROLOGIC TEST METHOD

BACKGROUND OF THE INVENTION

This invention relates to an in-situ permeability test using bore holes that is performed for the purpose of investigating the dynamic and hydraulic properties of crevices that serve as passages for underground water and, in particular, to a low-water-pressure controlled hydrologic test method in which the pressure in a measurement pipe is measured after establishing a certain water level in the pipe.

In a conventional JFT (Johnson Formation Test) method for measuring the permeability coefficient of ordinary rocks, a measurement pipe for water-level observation is inserted into a bore hole which has been bored into an aquifer. It is noted that the Johnson Formation Test is a nonsteady permeability test using double packer. Packers are provided in the lower section of the measurement pipe, and the permeability coefficient of the rock concerned is obtained from the rate at which the water level within the measurement pipe rises for the purpose of investigating and analyzing the crevices that serve as the passages for underground water.

FIG. 7 illustrates a conventional JFT test method. The reference numerals in the drawing respectively indicate the following: 31: bore hole; 32: measurement pipe; 33: strainer 34, 35: packers; 36: trip valve; 37: water level measuring element; 38: tester; 39: piping; 40: pressure control box; 41: go-devil; and 42: underground water level.

The measurement pipe 32 shown is closed at its front end, the packers 34 and 35 being provided around the lower section of the measurement pipe 32 with the strainer 33 between them. The trip valve 36 is provided in the upper section of the measurement pipe 32, and serves to prevent underground water from entering the pipe. The water level measuring element 37 inserted into the measurement pipe 32 is connected to the tester 38. The piping 39 for sending air under pressure connects the packers 34 and 35 to the pressure control box provided outside the measurement pipe 32.

As shown in the drawing, the strainer 33 is lowered together with the packers 34 and 35 to a position within the bore hole 31 where the permeability coefficient is to be obtained, air being conveyed under pressure by operating the pressure control box 40 so as to expand the packers 34 and 35, which seals in any spring water in the bore hole 31. Next, the tip of the go-devil 41 is hit against the trip valve 36 to open it instantaneously, which causes the underground water below the packer 34 to flow through the strainer section into the measurement pipe 32 and rise therein. This rising water level is electrically measured with the passage of time by means of the water level measuring element 37, the permeability coefficient being obtained from the elevated water level and the time that passes using Hvorslev's analysis equation, as follows, for the single-hole-type permeability test:

$$K=(2Rw)^2 In(mL/ra)/\{8L(t2-t1)\}In(H1/H2) \quad (1)$$

where

K: horizontal permeability coefficient (cm/s);

Rw: inner diameter of the measurement pipe (cm);

ra: diameter of the boring hole (cm);

L: length of the measurement section (cm);

m: permeability coefficient ratio in the vertical and horizontal directions (usually 1); and H1, H2: water levels t1, t2 (sec) after the water level rise start (cm).

The value In(H1/H2)/(t1-t1) in the above equation is obtained from the inclination of the linear section of a relationship curve of t-InH which is drawn on a semi-logarithmic coordinate sheet whose ordinary scale represents the time t and whose logarithmic scale the water level H.

By conducting measurement by this conventional JFT method until the underground water level attains equilibrium, the pore water pressure in the aquifer can be obtained from the water level subsisting at that time.

In a permeability test conducted by this conventional JFT test method, however, it is necessary to recover the trip valve each time the measurement depth is changed. That is, the measurement pipe has to be drawn up for each measurement, resulting in very low efficiency, particularly in a case where measurement for various depths is conducted within a deep bore hole. Moreover, the water hammer effect involved inevitably subjects the rock to dynamic damage, so that the condition of the rock will change. In addition, due to the great difference in head pressure, the clay in the rock crevices is displaced to cause clogging, resulting in a substantial lowering of the measurement accuracy. Furthermore, the measurement is conducted under a high water pressure that would not be generated under natural conditions. That is, the conditions under which the measurement is conducted are different from the natural state. Besides this, the t-logH curve obtainable with the present level of measurement techniques is mostly a curved line, so that the analysis will not reflect the actual state. In the case of an aquiclude, recovery of water level takes a long time, so that the measurement of the pore water pressure that is necessary for the analysis is inevitably a very time-consuming operation.

SUMMARY OF THE INVENTION

This invention aims at eliminating the above problems experienced with conventional hydrologic test methods. It is accordingly an object of this invention to provide a low-water-pressure-controlled hydrologic test method which makes it possible to conduct a continuous permeability test in a bore hole, which allows the time needed for pore water pressure measurement to be shortened to a remarkable extent, and which allows measurement to be conducted in a natural condition without needing to damage the existing rock condition.

In accordance with this invention, there is provided a low-water-pressure-controlled hydrologic test for a single-hole type permeability test using a double packer system in which packers are arranged above and below a strainer, comprising the steps of providing in a measurement pipe a valve which can be opened and closed and an inner packer which is equipped with a water pressure gage at its tip, and previously establishing an appropriate water level in the measurement pipe so as to diminish the difference in head pressure between the water level in the measurement pipe and the pore water level of the rock concerned.

BRIEF DESCRIPTION OF THE DRAWINGS

FIG. 4 shows the results of a measurement conducted in accordance with this invention;

DETAILED DESCRIPTION OF THE PREFERRED EMBODIMENTS

Figure 1:
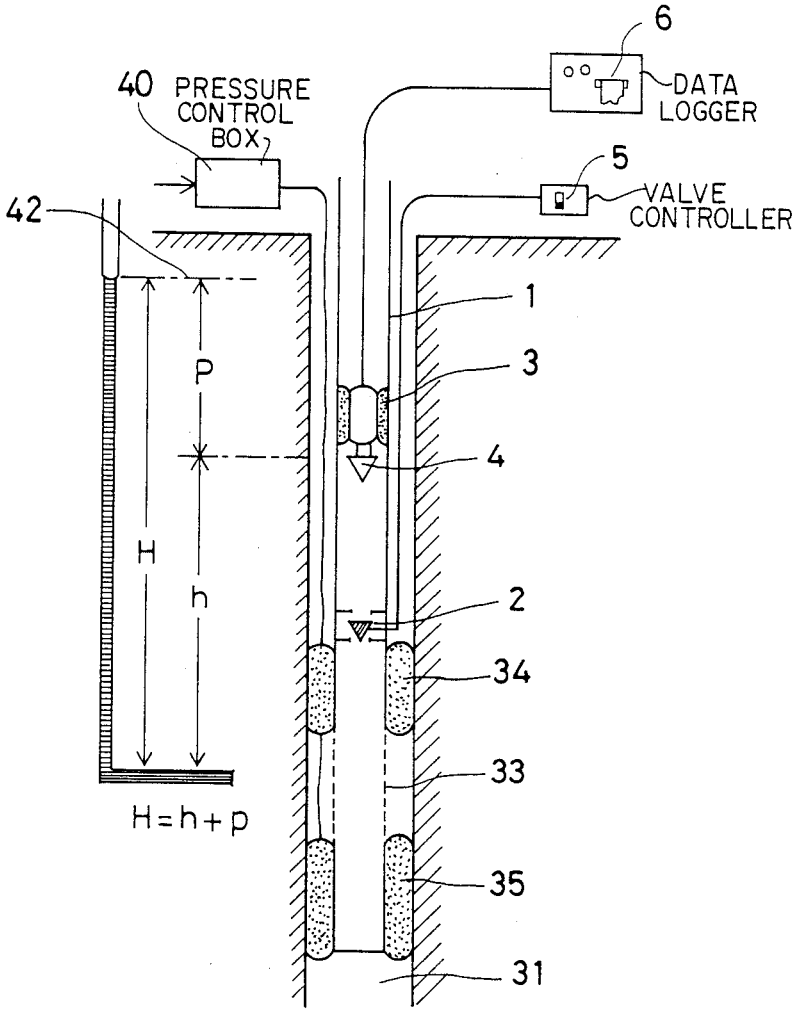
FIG. 1 illustrates the basic principle of this invention.
Figure 7:
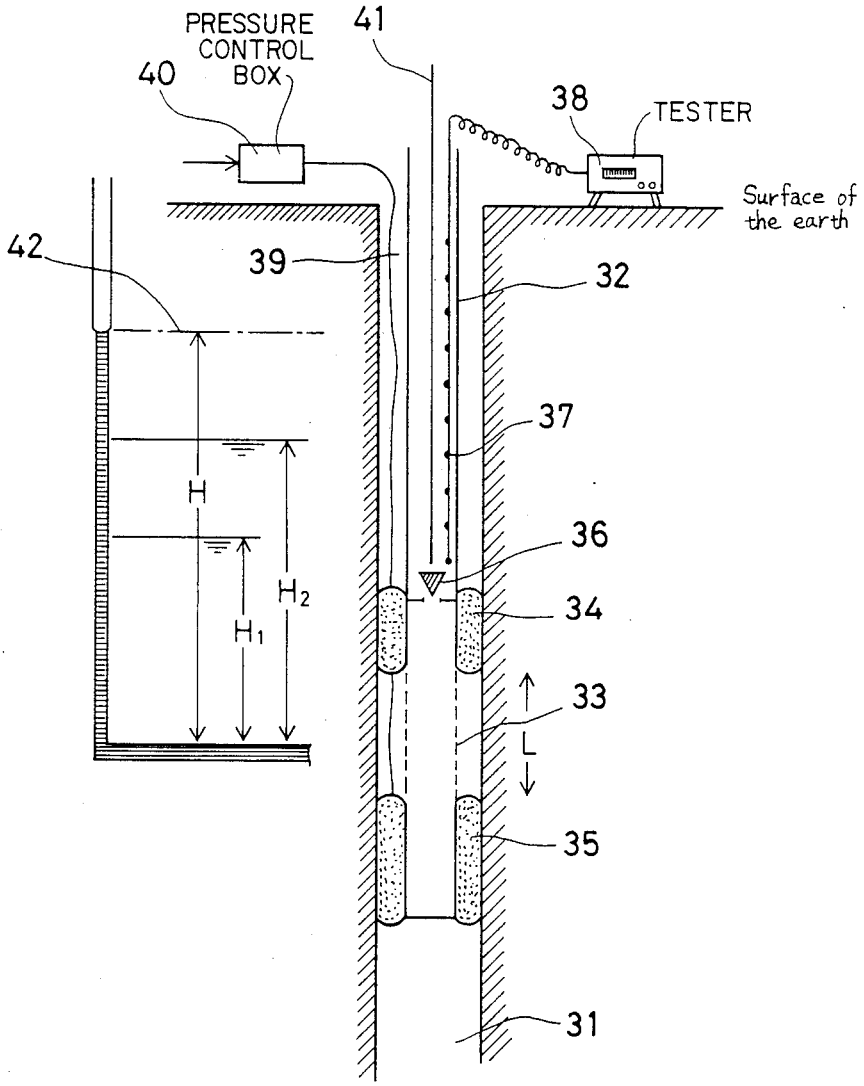
FIG. 7 PRIOR ART
FIG. 7 illustrates a conventional JFT test method.

An embodiment of this invention will now be described with reference to the attached drawings. FIG. 1 illustrates the basic principle of this invention, those components which are identical to those in FIG. 7 being referred to by the same reference numerals. The embodiment shown includes a measurement pipe 1, a valve 2 which can be opened and closed, an inner packer 3, a pore water pressure gage 4, a valve controller 5 for opening and closing the valve 2, and a data logger 6.

The measurement pipe 1 shown contains within the section thereof which is above a strainer 33 the valve 2 which can be opened and closed and the pore water pressure gage 4 for low pressures which includes the inner packer 3 and which can move vertically within the pipe. The valve 2 which can be opened and closed may be of the hydraulic type, the pneumatic type, the electrical type, etc. Of these, the pneumatic type is preferable since it is relatively free from trouble and it allows the opening and closing of the valve to be ascertained from air leakage. By varying the length of the strainer, the length of the measurement section defined by water-proof packers can be varied.

After opening the valve 2 and installing the measurement pipe 1 in such a manner that the strainer 33 is positioned at the measurement depth without expanding the inner packer 3, a pressure control box 40 is operated to expand the packers 34 and 35, thereby bringing them into close contact with the inner wall surface of the boring hole 31.

Both the JFT method and the pulse method can be applied to a permeability test in accordance with this invention. When the aquifer concerned exhibits satisfactory permeability, the former is adopted. When it exhibits poor permeability, much time is needed for the water level to recover, so in this case the latter is adopted.

In conducting a permeability test by the JFT method, the water level in the measurement pipe 1 is first appropriately adjusted by pumping or pouring water to diminish the head difference between the in-pipe water level and the underground one. The valve 2 is then opened, and the rise of the in-pipe water level is detected with the passage of time in terms of changes in water pressure utilizing the pore water pressure gage 4. The measurement results are displayed and recorded by means of the data logger 6, or are converted into water level values, thus obtaining the permeability coefficient from the equation (1) mentioned above in connection with the prior art.

In the case of a permeability test by the pulse method, a closed condition is established after pressurizing, analysis being performed on the basis of changes in the amount of permeating water obtained from the water compression amount per unit pressure and the packer change amount which are obtained from the pressure changes in the closed space, instead of obtaining the change in the amount of permeating water as changes in water level. That is, in this measuring apparatus, the water level in the measuring pipe 1 is appropriately adjusted, and, after pressurizing, the valve 2 is opened and the inner packer 3 expanded, thereby defining a closed space. By thus expanding the inner packer 3, the pressure in the hole increases in a pulse-like manner, the pressure wave thereof being propagated through the strainer into the rock and subsiding gradually.

To obtain the permeability coefficient K for the pulse method, the inner pressure change ΔP is used instead of the water level change ΔH. First, the virtual radius R is determined from the following equation:

$$\Delta V=\pi R^2\Delta H=(Cw\ Vw+\alpha)\Delta P$$

$$R=\sqrt{(CW\ VW+\alpha)\ \Delta P/\pi\alpha H}$$

where

Cw: water volume compression coefficient ($cm^3/kg$);

Vw: volume of water in the closed space below the inner packer ($cm^3$); and

α: coefficient of the packer compression correction by calibration ($cm^3/kg$).

Accordingly, the equation (1) can be rewritten as follows:

$$K=(2R)^2 In(mL/ra)/\{8L(t2-t1)\}In(P1/P2)$$

The pore water pressure is obtained as follows: first, the packers 34 and 35 are expanded to bring them into close contact with the inner wall of the boring hole 31, and the water level in the measurement pipe 1 is appropriately adjusted by pumping or pouring water. The valve 2 is then opened and the inner packer 3 expanded, thereby defining a closed space. After the indication of the data logger 6 based upon the detection conducted by means of the pore water pressure gage 4 has been stabilized, the pore water pressure can be obtained.

Figure 2:
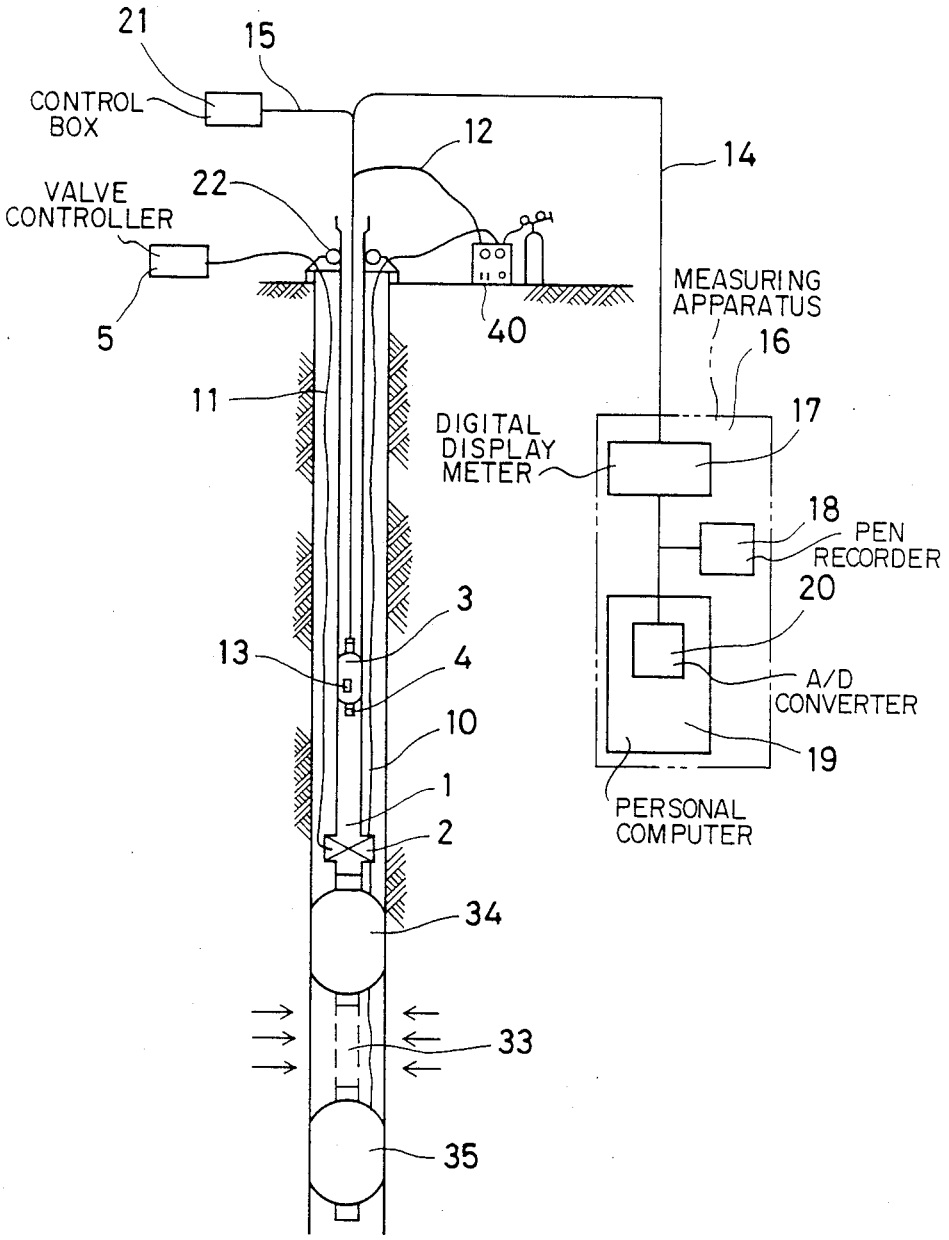
FIG. 2 shows an embodiment of the apparatus for the low-water-pressure-controlled hydrologic test in accordance with this invention.
Figure 3:
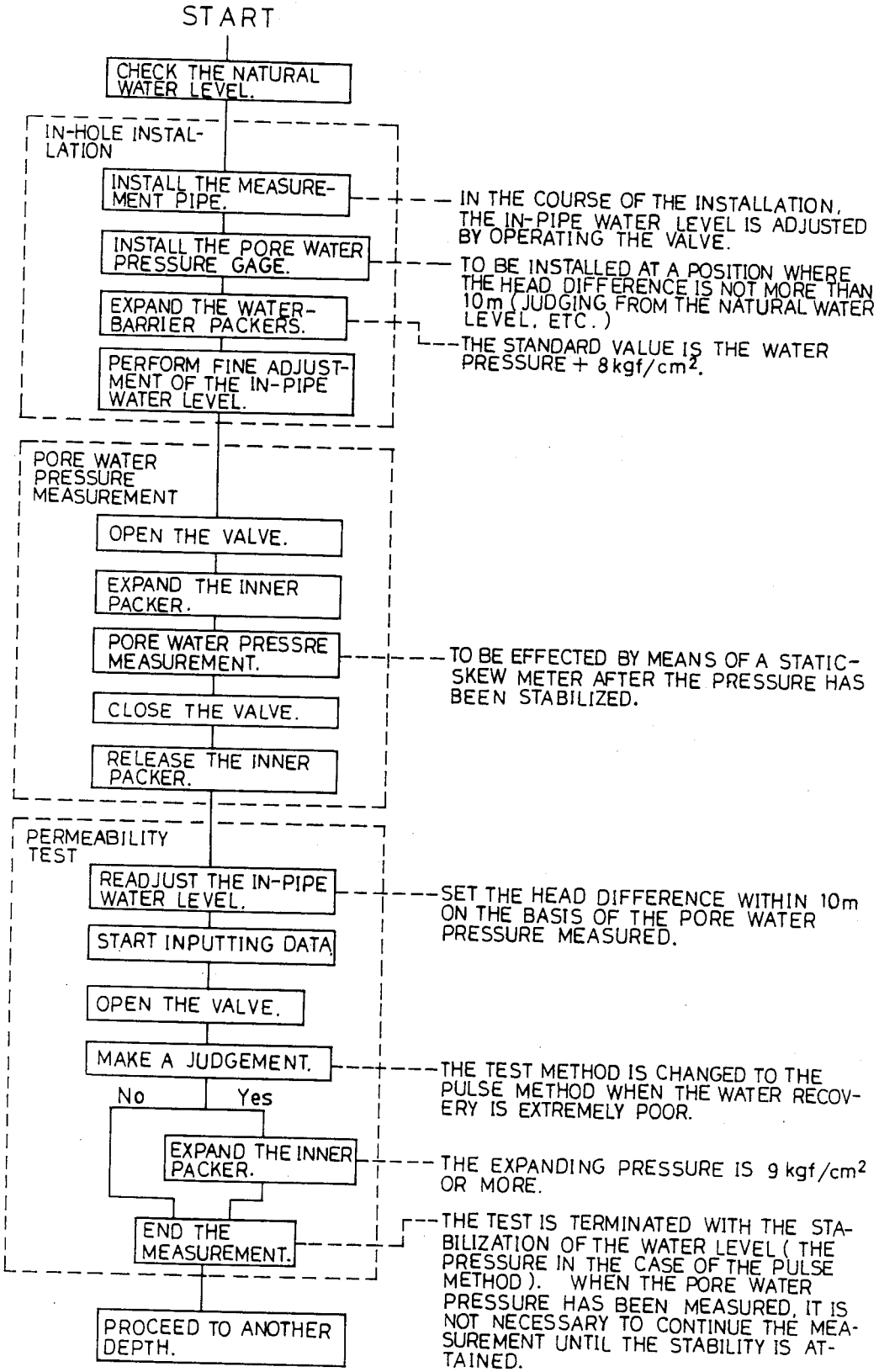
FIG. 3 shows the measurement procedures of this invention.

FIG. 2 shows an embodiment of the low-water-level-controlled hydraulic test apparatus in accordance with this invention, and FIG. 3 is a flowchart showing the measurement procedures, those components which are identical to those of FIG. 1 being referred to by the same reference numerals. The embodiment shown in FIG. 2 includes piping 10, 11, 12, an electromagnetic valve 13, an armored cable 14, a cable 15, a measuring apparatus 16, a digital display meter 17, a pen recorder 18, a personal computer 19, an AD converter 20, a control box 21 and measurement pipe holder 22.

The measurement pipe 1 shown is open at its upper end and is closed at its lower end. Provided in the lower section of the pipe are a strainer 33, and packers 34, 35 respectively situated above and below the strainer 33 and controlled through the piping 10 by a pressure control box 40 provided on the ground. Provided within the section of the measurement pipe 1 above the packer 34 is a valve 2 which is opened and closed through the piping 11 by a valve controller 5 provided on the ground. A vertically movable pore water pressure gage 4 is provided in the section of the measurement pipe 1 above the valve 2. The pore water pressure gage 4 is equipped with an inner packer 3 and an electromagnetic valve 13. By expanding the inner packer 3, a closed space containing the pore water pressure gage 4 is defined in the measurement pipe 1. If the pressure rise in this close space is too strong, the electromagnetic valve 13 is opened to prevent the pore water pressure gage 4 from being broken. The water pressure signal from the pore water pressure gage 4 is transmitted through the armored cable 14 to the digital display meter 17, the pen recorder 18, the personal computer 19, etc. in the measuring apparatus 16. The inner packer 3 and electromagnetic valve 13 are respectively connected to the pressure control box 40 and the control box 21 which are on the ground through the piping 12 and the cable 15, respectively.

Next, the measuring procedures will be explained with reference to FIG. 3.

First, by operating the pressure control box 40 to open or close the valve 2, the water level in the measurement pipe 1 is adjusted and ascertained (Step 1). While doing this, the strainer of the measurement pipe 1 is lowered through the measurement pipe holder 22 until it reaches the position in the bore hole 31 corresponding to the measurement depth. Then, the pore water pressure gage 4 is set at a position where the head difference as evaluated from the natural water level, etc. does not exceed 10 m (Steps 2 and 3). After that, the water barrier packers 34 and 35 are expanded to bring them into close contact with the wall of the bore hole 31, and the water level in the measurement pipe 1 is so adjusted that it is at the level of the pore water pressure gage 4 (Steps 4 and 5).

Afterwards, the valve 2 is opened by operating the valve controller 5 (Step 6), and the inner packer 3 is expanded to define a closed space (Step 7). The water pressure transmitted from the strainer 33 is then displayed and recorded by means of the measuring apparatus 16 until the pressure is stabilized. Then, the pore water pressure is measured (Step 8). Next, the valve 2 is closed (Step 9), the expansion of the inner packer 3 being released to finish the pore water pressure measurement (Step 10).

Next, a permeability test is conducted. That is, on the basis of the pore water pressure measured, the water level in the measurement pipe 1 is so adjusted that the head difference does not exceed 10 m (Step 11). The measuring apparatus 16 is then operated, and the valve 2 opened, measuring the recovered water level in terms of water pressure with the passage of time and inputting the data obtained (Step 12). The water pressure value is converted into one of water level to obtain the coefficient of permeability. If the water level recovery in the permeability test is unsatisfactory, a judgment is made as to whether the test method should be changed to the pulse method (Step 14). If the water level recovery is extremely poor, the inner packer 3 is expanded (Step 15), and the pressure in the measurement pipe is raised in a pulse-like manner to obtain the permeability coefficient from the pressure change with respect to the passage of time.

If the water level recovery is judged to be not so poor in Step 14, the measurement at that depth is complete. If the pore water pressure is has been measured, the test is complete with the stabilization of the water level in the case of the JFT method, and with that of the pressure in the case of the pulse method. If no pore water pressure has been measured, the test is terminated with the stabilization of the water level or the pressure, the strainer being moved to the next measurement depth. After that, the measurement is conducted for each depth in a similar manner.

FIG. 4 shows the results of an analysis performed by the method of this invention.

In this analysis, the permeability coefficient was obtained for a certain spot over an range from GL(underground)-38 m to GL-165 m. J denotes the JFT method, and P the pulse method.

It will be appreciated from FIG. 4 that the pore water pressure exhibits an approximately hydrostatic distribution, concentrating, in terms of water level, around GL-17 m. The points No. 2 and 3 indicate a slight deviation from this. Seeing that the corresponding permeability values are small, it may be concluded that this section constitutes a local hydrologically abnormal zone. Further, since the water level is the same over the range from GL-38 m to GL-165 m, it is quite likely that the crevice zone which was subjected to the measurement runs continuously in the longitudinal direction.

Figure 5:
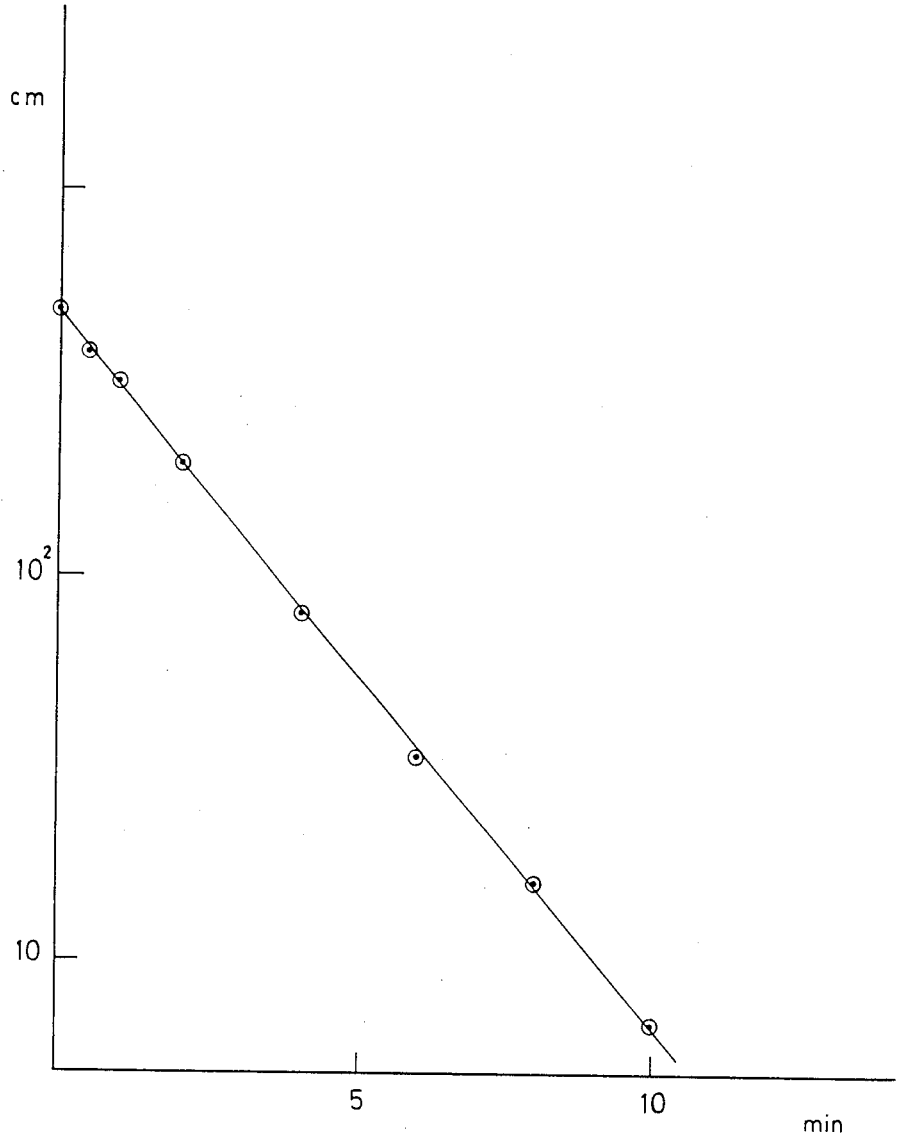
FIGS. 5 and 6 show the way the water level (water pressure) changes with the passage of time.
Figure 6:
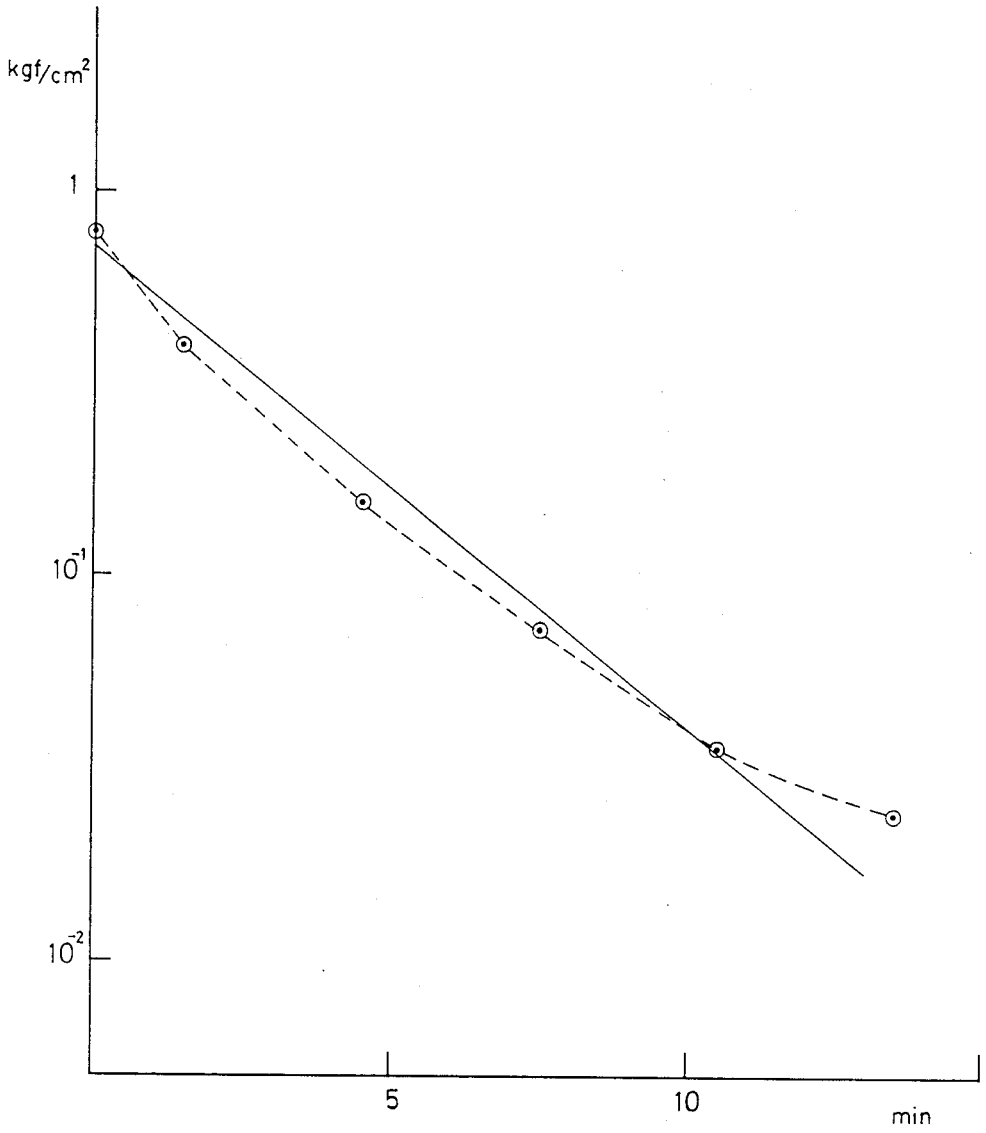

FIGS. 5 and 6 show the t-logH curves at GL-38 m to 40.30 m and GL-50.35 to 52.65 m.

In the case of the measurement data shown in FIG. 4, most of the t-logH curves are represented as straight lines, as shown in FIG. 5. It should be noted, however, that the abovementioned Hvorslev's equation does not take the storage coefficient into consideration. If the storage coefficient is large, the t-logH curve is not a straight line. In the case of the t-log curve shown in FIG. 6, the storage coefficient exhibits a value which cannot be neglected. Seeing that its permeability coefficient is small despite the fact that the section is in a crevice zone, it may be concluded that its crevice is clogged up with clay.

Thus, in accordance with the present invention, the measurement pipe contains an inner packer which is equipped with a water pressure gage that can be operated on the ground and as well as a valve which can be opened and closed, and an appropriate water level is established in advance in the measurement pipe so as to diminish the pressure difference between the in-pipe pressure and the pore water pressure of the rock concerned. This arrangement helps to the measurement time to a remarkable degree, which has been inevitably long particularly in the case of an aquiclude. Furthermore, since there is no need for the measurement pipe to be drawn up each time a permeability measurement is finished, the measuring operation can be conducted continuously, resulting in an enhanced operational efficiency, which is particularly true in measurements conducted at depths. In addition, since the difference in water pressure can be diminished, the rock is subjected to less damages. Moreover, since the measurement can be conducted in a condition akin to the natural state, improvement in measurement accuracy can be expected.

While the invention has been particularly shown and described in reference to preferred embodiments thereof, it will be understood by those skilled in the art that changes in form and details may be made therein without departing from the spirit and scope of the invention.

What is claimed is:

1. A low-water-pressure-controlled hydrologic test method for a single-hole type permeability test using a double packer system in which packers are arranged above and below a strainer, comprising the steps of providing in a measurement pipe a valve which can be opened and closed and an inner packer which is equipped with a water pressure gage at its tip, and establishing an appropriate water level in advance in the measurement pipe so as to diminish the difference in head pressure between the water level in the measurement pipe and the pore water level of the rock concerned.

2. A low-water-pressure-controlled hydrologic test method as claimed in claim 1, wherein permeability coefficients are obtained through detection of water levels which are obtained as water pressure values, said detection being effected by opening said valve.

3. A low-water-pressure-controlled hydrologic test method as claimed in claim 1, wherein pore water pressure values are obtained through detection of the pressure in the measurement pipe, said detection being effected after opening said valve and expanding said inner packer.

4. A low-water-pressure-controlled hydrologic test method as claimed in claim 1, wherein permeability coefficients are obtained through detection of changes in the pressure in the measurement pipe, said detection being effected while raising the pressure in the measurement pipe in a pulse-like manner by expanding said inner packer.

5. A low-water-pressure-controlled hydrologic test method as claimed in claim 1, wherein any pressure rise in the measurement pipe effected by means of the inner packer is controlled by means of an electromagnetic valve.

6. A low-water-pressure-controlled hydrologic test method as claimed in claim 1, wherein said valve which can be opened and closed is pneumatically controlled on the ground, thereby preventing any abnormal pressure rise in the measurement pipe.

* * * * *